US005705229A

United States Patent [19]

Abiven et al.

[11] Patent Number: 5,705,229

[45] Date of Patent: Jan. 6, 1998

[54] PROCESS FOR PRODUCING COMPOSITE MATERIAL COMBINING A MAGNESIUM ALLOY CONTAINING ZIRCONIUM WITH A CARBON REINFORCEMENT

[75] Inventors: Henri Abiven, Hontcient; Lionel Picquet, Albert; Gilles Claveyrolas, Puteaux; Jean-Claude Viala, Villeurbanne; Jean Bouix, Lyons, all of France

[73] Assignee: Aerospatiale Societe Nationale Industrielle, France

[21] Appl. No.: 639,195

[22] Filed: Apr. 26, 1996

Related U.S. Application Data

[62] Division of Ser. No. 417,444, Apr. 5, 1995, Pat. No. 5,548,976, which is a continuation of Ser. No. 120,249, Sep. 10, 1993, abandoned.

[30] Foreign Application Priority Data

Sep. 10, 1992 [FR] France ..... 92 10797

[51] Int. Cl.[6] ..... B05D 1/18

[52] U.S. Cl. ..... 427/431; 427/444.2; 428/608; 428/614

[58] Field of Search ..... 427/431, 444.2; 428/608, 614

*Primary Examiner*—Bernard Pianalto

*Attorney, Agent, or Firm*—Hayes, Soloway, Hennessey, Grossman & Hage, P.C.

[57] ABSTRACT

The invention relates to a composite material combining a magnesium alloy containing zirconium with a carbon reinforcement, as well as to its production process.

According to the invention, such a composite material is prepared by the infiltration of a reinforcement formed from graphite or carbon fibres by a liquid magnesium alloy containing 0.3 to 1% by weight zirconium at a temperature of 650° to 850° C.

Under these conditions, on said fibres is formed a zirconium carbide layer containing magnesium in solid solution and e.g. complying with the formula $ZrC_xMg_y$ with $0.3<x<1$ and $0.02<y<0.12$, which leads to the wetting of the fibres by the melted magnesium and to a good adhesion between the fibres and the matrix, without any deterioration to the mechanical characteristics of the fibres.

4 Claims, No Drawings

PROCESS FOR PRODUCING COMPOSITE MATERIAL COMBINING A MAGNESIUM ALLOY CONTAINING ZIRCONIUM WITH A CARBON REINFORCEMENT

This is a divisional of application Ser. No. 08/417,444 filed on Apr. 5, 1995, U.S. Pat. No. 5,548,976, which is a continuation application of Ser. No. 08/120,249, Sep. 10, 1993, abandoned.

The present invention relates to a composite material comprising a magnesium alloy-based metal matrix and a carbon reinforcement formed from graphite or carbon filaments or fibres.

The incorporation of particles, fibres or mineral trichites into metal matrixes constituted by metals having a low density such as alloys based on aluminium or magnesium makes it possible to obtain composite materials having specific mechanical properties superior to those of conventional alloys, particularly with regards to the breaking strength, rigidity and the maintaining of these properties in fatigue and thermal cycling. Among the different reinforcements which can be incorporated into such metal matrixes, graphite or carbon fibres have a particular interest due to their excellent intrinsic characteristics, namely a very high breaking strength (up to 4400 MPa), very high rigidity (up to 800 GPa), a slightly negative thermal expansion coefficient and low density (1.76 to 2.18).

Thus, composite materials incorporating such carbon reinforcements have always been used in various industrial fields such as motor vehicles (pistons, jackets, rods), as well as the aeronautical and aerospace fields (structural elements for shuttles, supports for reflectors, etc.) and it is very probable that there will be significant advances with respect thereto over the next few years.

The known processes for producing such composite materials use solid phase methods or liquid phase methods. In the case of solid phase methods, the material can e.g. be produced by the extrusion of a mixture of the constituents or by heat compression of layers of fibres forming the reinforcement and which have previously been metallised.

The production procedures using liquid phase methods can consist of infiltrating the metal or melted alloy constituting the matrix, under a varying pressure, into woven or non-woven preforms, or mixing constituents in the pasty phase, optionally in the presence of an easily eliminatable binder. The methods involving the pressurized infiltration of the metal or melted alloy into unidirectional layers of long, stretched fibres or into woven preforms lead at present to materials having the highest mechanical characteristics.

However, when the infiltration method is used with light metals such as aluminium or magnesium, certain difficulties are encountered in obtaining a satisfactory connection or bond between the fibres of the reinforcement and the metal matrix.

Thus in the case of aluminium-based matrixes, the infiltration of the aluminium or aluminium alloy into the layers or preforms constituted by carbon fibres causes certain problems, because carbon is not chemically stable in the presence of pure or alloyed aluminium. Thus, as soon as the temperature exceeds approximately 450° C., a reaction occurs between the fibres and the matrix leading to the formation of aluminium carbide $Al_4C_3$, which leads to a damage by puncturing of the surface of the fibres and to a rapid deterioration of their intrinsic mechanical characteristics.

Moreover, despite the chemical interaction leading to the formation of aluminium carbide, the wetting of the fibres by aluminiun is very poor, which make it necessary to carry out infiltration under a high pressure, whilst the adhesion between the aluminium and the fibres in the composite remains low.

To overcome these difficulties various surface treatments have been developed for said carbon or graphite fibres, said treatments e.g. consisting of coating the surface of the fibres with an appropriate compounds such as zirconium or titanium carbide, as is described in U.S. Pat. No. 4,600,661 with reference to Japanese document 49-18891 and Nieh and Vidoz in J. of Am. Ceram. Soc., vol. 65, No. 5, May 1982, pp 227–230.

In U.S. Pat. No. 4,600,661 reaction between the fibres and the aluminium matrix is prevented by adding titanium or zirconium to the melted aluminium during infiltration, which leads to the formation on said fibres of a Ti or Zr carbide layer in place of aluminium carbide. However, this procedure encounters problems in controlling or monitoring the formation of said layer in such a way as to maintain the mechanical properties of the fibres.

In the article by Nieh et al, a Ti or Zr carbide layer is formed on the fibres before including then in the aluminium matrix, which makes it possible to monitor the formation of the layer and leads to a double layer of TiC and $Ti_4Sn_2C_2$ favouring the wetting of the fibres by aluminium. However, the need to carry out such a treatment makes the production process more complicated and slows down the development of such a composite material.

In addition, development has taken place of composite materials having a carbon reinforcement using a magnesium-based metal matrix, because magnesium has two important advantages compared with aluminium. On the one hand, magnesium has a density well below that of aluminium (1.74 instead of 2.7), which can make it possible to obtain even higher specific mechanical characteristics. On the other, unlike in the case of aluminium, magnesium has an excellent chemical inertia relative to carbon, provided that the latter is sufficiently graphitized, which is the case with most commercially available reinforcing fibres. Therefore there is no significant deterioration of the intrinsic characteristics of a reinforcement constituted by such fibres due to a chemical reaction with the metal of the matrix, during the hot production of composite materials using a matrix based on magnesium and a carbon reinforcement.

Nevertheless, although the carbon fibres are not deteriorated by the chemical reaction with the magnesium, two major problems remain for the production of such composite materials. The first is to allow a uniform penetration of the liquid magnesium in the reinforcing fibres and the second is to obtain an adequate adhesion at the metal/fibre interface.

In order to solve these two problems, various treatments of the reinforcing fibres have been proposed and in particular treatments consisting of coating the surface of the fibres with a metal, e.g. nickel, or insertion compounds wettable by the liquid matrix, as described in Chemical Abstracts, vol. 86 (2), No. 7835k and FR-A-2 259 916.

Titanium-based coatings have also been produced on graphite fibres intended to be infiltrated by a liquid magnesium alloy, as described in Chemical Abstracts, vol. 106 (20), No. 161024h and vol. 106 (8), No. 54243g. However, certain difficulties are encountered in obtaining with such treatments a uniform coating of each fibre of the carbon reinforcement. Moreover, the need to carry out a preliminary treatment on the fibres, prior to their infiltration by the metal of the matrix, makes the composites metal production process more complicated.

A process for producing a composite material combining a magnesium-based matrix and a carbon reinforcement is known, in which use is made for the matrix of a magnesium alloy containing 2 to 8% by weigh zinc, less than 2% by weight zirconium and less than 1% by weight aluminium, in order to avoid a deterioration of the carbon reinforcement by the alloy of the matrix and therefore increase the mechanical strength of the resulting composite material, as described in U.S. Pat. No. 4,600,661. In this process, the addition of zinc to the magnesium alloy lowers the melting point of the latter and improves its fluidity in the molten state, which makes it possible to bring about the infiltration under pressure of the carbon reinforcement by the magnesium alloy under better conditions. In addition, the limitation of the zirconium and aluminium contents of the alloy makes it possible to avoid what are considered to be prejudicial reactions between the Al, Zr and carbon of the carbon reinforcement.

However, according to the invention and contrary to this teaching, it has been found that a reaction between the zirconium and the carbon of the reinforcing fibres could be beneficial and that the problems of the wetting of the carbon fibres by the magnesium and the adhesion between these fibres and the magnesium matrix could be solved by adding zirconium to the magnesium-based matrix without any deterioration to the mechanical characteristics of the composite material.

The present invention also relates to a composite material incorporating a magnesium alloy matrix containing zirconium and a reinforcement constituted by carbon or graphite fibres dispersed in said matrix and having a zirconium carbide layer containing magnesium in solid solution, at the interface between the fibres and the magnesium-based matrix.

Advantageously, the carbide of the layer is in accordance with the formula:

$$ZrC_xMg_y$$

in which x and y are such that:

$$0.3<x<1,$$

and $$0.02<y<0.12.$$

In this material, the presence of the $ZrC_xMg_y$ carbide layer on the fibres makes it possible to solve the problems of the wettability of the fibres by the metal of the matrix and the adhesion between the fibres and the matrix, without reducing the mechanical characteristics of the composite material. The formation of such a carbide layer for solving these problems and resulting from the choice of a magnesium-based matrix has never been envisaged up to now.

Thus, as described in U.S. Pat. No. 4,600,661, use has already been made of a titanium carbide or zirconium carbide layer, formed on carbon fibres by the addition of zirconium or titanium to the molten aluminium, in order to avoid the prejudicial formation of aluminium carbide on said fibres during their infiltration by aluminium. Thus, it was not a question of a zirconium carbide layer containing magnesium in solid solution as in the present invention. Moreover, the function of said layer was to prevent the prejudicial reaction between the carbon of the fibres and the metal of the matrix, said reaction not occurring in the case of a magnesium matrix.

This document also states that the zirconium carbide layer reduces the adhesion between the carbon fibres and the metal of the matrix, which is precisely one of the problems solved in the invention due to the use of a carbide layer such as $ZrC_xMg_y$.

According to the invention, the graphite or carbon fibres used in the carbonreinforcement have a high breaking strength, e.g. higher than 1800 MPa, and a high modulus of elasticity, e.g. higher than 200 GPa. In order to obtain a good wetting and a good adhesion at the interface between the metal and the fibres, it is essential that the surface of the latter is mainly formed from carbon. It is therefore appropriate to carefully desize the fibres prior to their impregnation by the liquid metal. However, for producing the material it is possible to use bare graphite or carbon fibres or graphite or carbon fibres having on their surface a graphite or carbon layer, e.g. with a thickness of 0.03 to 0.3 μm, which has previously been deposited by known procedures such as pyrolysis of liquid or gaseous organic precursors, PVD, etc. The carbon reinforcement can be in different forms.

Thus, it can have at least one cylindrical wick constituted by 200 to 24000 carbon or graphite fibres having an average diameter d below 50 μm.

It can also be formed by one or more unidirectional layers, each of which is obtained by the spreading out and/or juxtaposing of one or more carbon or graphite fibre wicks having average diameter d below 50 μm. When use is made of several unidirectional layers, the reinforcement can be formed by a stack of said layers, optionally in crossed form.

The reinforcement can also be constituted by a two or three-dimensional preform produced by weaving carbon or graphite fibre wicks having an average diameter d below 50 μm and using conventional procedures. The reinforcement can also be constituted by an unwoven, porous body in the form of broken graphite or carbon fibre wicks and optionally retained by an easily eliminatable binder.

With such reinforcements, it is possible to obtain composite materials having the shape of a continuous thread, a continuous tape, a plate or a solid with a complex shape resulting from the impregnation of the aforementioned reinforcements by the liquid alloy of the matrix.

The composite materials according to the invention can be produced by a process consisting of infiltrating into the reinforcement formed from carbon or graphite fibres and preferably having an average diameter d below 50 μm, a liquid magnesium alloy containing 0.3 to 1% by weight zirconium, at a temperature of 650° to 850° C., whilst maintaining said temperature for a period between 2 and 60 min.

The infiltration of the liquid magnesium alloy into the carbon reinforcement can be carried out by any random procedure, e.g. by immersing the carbon reinforcement in a molten magnesium alloy bath, or by raising to a temperature of 650° to 850° C. an assembly having the carbon reinforcement, the magnesium alloy and optionally zirconium powder.

In the latter case, it is e.g. possible to carry out the infiltration by the hot compression of a alternating stack of carbon or graphite fibre reinforcements, magnesium alloy strips and zirconium powder.

Under these conditions, the zirconium carbide layer containing magnesium in solid solution and e.g. of formula $ZrC_xMg_y$ is directly formed on the fibres at the interface between the fibres and the magnesium-based matrix, during the infiltration of the molten alloy into the carbon reinforcement.

The formation of this layer on the one hand aids a good wetting of the fibres by the molten magnesium alloy and on the other leads to the obtaining of a satisfactory bend between the fibres and the magnesium-based matrix.

Thus, it has been found that the presence of zirconium in a sufficiently concentrated solution (more than 0.3% by weight), e.g. 0.3 to 1% by weight, in the magnesium anables the molten magnesium to gradually penetrate the interior of all the open pores of the reinforcement, without it being necessary to use a high infiltration pressure and/or coat beforehand each fibre of the reinforcement with an appropriate deposit. This excellent penetrating power results from the fact that the thin, continuous, adhesive carbide layer $ZrC_xMg_y$ and in particular $ZrC_{0.3}Mg_{0.09}$ very rapidly forms on the surface of each fibre of the reinforcement by chemical reaction with the zirconium dissolved in the magnesium. The carbide constituting the interaction layer can be likened to the cubic symmetry zirconium carbide ZrC, but in solid solution it contains a little magnesium and can be non-stoichiometric. It corresponds to the chemical formula $ZrC_xMg_y$ with x between 0.3 and 1 and y between 0.02 and 0.12.

Analysis by X-ray diffraction of the phase $ZrC_xMg_y$ obtained by reacting at 727° C. between the powders of graphite, Zr and Mg in atomic proportions 20/10/70, for 60 h, has revealed that it is a cubic symmetry phase belonging to the same symmetry class as zirconium carbide ZrC, having a mesh parameter a=4.697(4) Å close to that of pure ZrC (a=4.6930 Å). This is why carbide $ZrC_xMg_y$ is looked upon as a non-stoichiometric zirconium carbide containing a little magnesium in solid solution, which slightly expands its mesh. On the basis of the mesh parameter a, the density $d_c$ of the carbide $ZrC_xMg_y$ has been calculated in the hypothesis where the magnesium occupies interstitial sites in the ZrC structure and for the formula $ZrC_{0.38}Mg_{0.09}$ determined experimentally by analysis. This led to a value $d_c$ of 6.28 g/cm$^3$, which is only slightly different from that given for pure ZrC (6.634 g/cm$^3$).

It has also been observed that the carbide $ZrC_xMg_y$ is poorly crystallized even after a 206 h heat treatment. In addition, the deposit formed on the fibres with much shorter durations is quasi-amorphous, which is very favourable for maintaining the mechanical properties of the carbon or graphite fibres.

The growth of the $ZrC_xMg_y$ layer on the fibres takes place by unidirectional solid phase carbon diffusion through the layer. Therefore the thickness of said layer, which is proportional to the square root of the infiltration time, grows at a speed which decreases with an increase in the layer thickness. Therefore the growth process is kinetically self-regulated. Following infiltration and complete solidification of the magnesium-based matrix, strong chemical bonds are established by means of the carbide layer $ZrC_xMg_y$ between the matrix and the fibres, which ensures a good charge transfer into the composite material and a satisfactory maintaining of its mechanical properties in fatigue. Moreover, the interface between the matrix and the reinforcement can not further evolve by chemical reaction, because the growth kinetics of the compound $ZrC_xMg_y$ becomes quasi-zero as soon as the matrix is in the solid state.

The variation of the thickness in μm of the $ZrC_xMg_y$ layer formed on the surface of the carbon fibres P 55 as a function of the contact time in min with a Zr-saturated MgZr alloy and as a function of the temperature in K for temperatures from 930 to 1100 K is given by the expression:

$$\log_{10}e=(3.885-5434/T)+1/2\log_{10}t$$

in which t represents the time in min and T the temperature in K.

although this expression is very approximate, it gives information on the order of magnitude of the thickness of the layer. Thus, after 15 min interaction at 670° C., the layer thickness is approximately 0.05 μm.

This expression is only valid for type P 55 or P 100 fibres, whose characteristics are given in the attached table, or for fibres having on the surface a pyrolytic carbon deposit e.g. obtained by cracking under low pressure of methane at approximately 1400° C. Thus, after 16 h at 670° C., there is a layer thickness of approximately 1 μm on M 40B fibres with a polyacrylonitrile (PAN) precursor, whereas in the case of P 55 or P 100 fibres, the layer thickness is approximately 0.6 μm under the same conditions.

These differences are doubtless due to the variation in the degree of graphitization of the fibres and/or orientation differences of the graphite flakes at the surface in contact with the liquid. Thus, the flakes are oriented parallel to the interface in the case of fibres formed from pitch, whereas they are oriented perpendicular to the interface in the case of fibres formed from PAN.

In view of the fact that the carbon contained in the carbide layer $ZC_xMg_y$ formed at the fibre-matrix interface results from the attacking of the surface of the fibres by zirconium, it is important that the thickness of said interaction layer is not too great so as to ensure that the carbon or graphite fibres retain their excellent intrinsic mechanical characteristics. In this connection, the use of fibres previously coated with an approximately 0.1 m thick carbon deposit can be advantageous. Preferably, the thickness of the carbide layer $ZrC_xMg_y$ must be at the most 5 d/100 with d representing the diameter of the fibres. Preferably, it is approximately d/100. Thus, in the case of carbon fibres with an average diameter of 6 to 7 μm, the thickness of the carbide layer $ZrC_xMg_y$ is preferably below 0.06 to 0.07 μm and does not exceed 0.3 to 0.35 μm. In the case of fibres with an average diameter of 10 μm, these values are respectively approximately 0.1 and 0.5 μm.

With such layer thicknesses, the mechanical properties of the composite material have values only slightly modified compared with the theoretical values forecastable by the law of mixtures. Thus, a unidirectional carbon reinforcement totally infiltrated by a Mg—Zr alloy can have a breaking strength at least equal to 70% and a modulus of elasticity at least equal to 90% of the values theoretically forecastable by the law of mixtures.

As has been shown hereinbefore, the thickness of the carbide layer formed at the interface between the matrix and the reinforcement depends both on the nature of the fibres forming the reinforcement, the contact time between the fibres and the liquid matrix and the temperature at which the latter is maintained.

For average graphitized fibres such as P 55 fibres, a 0.3 μm thick carbide layer can be obtained in 60 man at 747° C. In view of the fact that it is preferable for the interaction layer to have a much lower thickness and for said thickness to vary in proportion to the square root of time, it is clear that the desired thickness will be rapidly obtained and that the composite material production conditions are perfectly compatible with standard industrial procedures for liquid phase infiltration by gravity or under average pressure of the metal forming the matrix.

According to the invention, the zirconium quantity present in the magnesium alloy used for the infiltration of the carbon reinforcement must be adequate to permit the growth of an adequately thick layer, whilst ensuring that the reactive wetting process retains its kinetically self-regulated character. In general, the zirconium quantity present in the magnesium alloy is 0.3 to 1% by weight.

However, as the solubility of the zirconium in the magnesium is relatively low (0.6 to 0.7% by weight) at temperatures of 650° to 850° C. such as are generally used for infiltration, it can be advantageous to maintain the zirconium content of the liquid magnesium at a sufficiently high level, which can be equal to the solubility limit of the zirconium in the magnesium at the infiltration temperature.

This can be obtained by known procedures, e.g. by the partial metallization of the reinforcement by zirconium using the vapour phase deposition procedure, by adding fragments, bars, plates or cylinders of zirconium to the molten magnesium bath, or by melting the bath in a zirconium or zirconia crucible.

The minimum zirconium quantity which must be added to the magnesium matrix to obtain a ZrC Mg layer of the desired thickness on the carbon fibres of radius $r_f$ and volume $d_f$ is dependent more particularly on the volume fraction of fibres $V_f$ of the composite material.

In order to evaluate said minimum zirconium weight a calculation firstly takes place of the weight $m_{Zr}$ contained in a layer of thickness e on a filament of radius $r_f$ and length L. As remains small compared with $r_f$, the volume of the layer $V_c$ is equal to $$V_c=2\pi\cdot r_f e\cdot L \quad (1)$$

Therefore the weight of the layer $m_c$ is equal to:

$$m_c=2\cdot r_f e\cdot L\cdot d_c \quad (2)$$

in which $d_c$ is the density of the layer, which is 6.28 $g.cm^{-3}$. If $x_O$ is the mass fraction of Zr in the layer, the mass of Zr contained therein is consequently:

$$m_{Zr}=2\pi\cdot r_f e\cdot L\cdot d_c\cdot x_O \quad (3)$$

For the atomic composition indicated hereinbefore ($ZrC_{0.38}Mg_{0.09}$), $x_O$=0.93.

It is now necessary to arrive at the fibre volume fraction in the composite $V_f$. For this purpose, the mass of fibres $m_f$ in the volume unit of the composite is expressed in two different ways. We obtain on the one hand if $d_f$ is the density of the fibres:

$$m_f=\cdot r_f^2\cdot L\cdot d_f \quad (4)$$

and on the other hand, V being the volume fraction of the fibres in the composite:

$$m_f=V_f d_f \quad (5)$$

By combining (4) and (5), we obtain:

$$L=V_f/r_f^2 \quad (6)$$

By replacing L in (3) by its expression given by (6), we obtain for the volume unit of the composite:

$$m_{Zr}=2\pi\cdot r_f e\cdot V_f d_c\cdot x_O/r_f^2 \quad (7)$$

and by simplifying:

$$m_{Zr}=2\cdot d_c\cdot x_O V_f e/r_f \quad (8)$$

If now we express the ration $m_{Zr}/m_{Mg}$, still for the volume unit of the composite, it becomes:

$$m_{Zr}/m_{Mg}=2\cdot d_c\cdot x_O\cdot e\cdot V_f/r_f d_{Mg}\cdot(1-V_f) \quad (9)$$

Thus, we obtain the minimum value initially required for the ratio of $m_{Zr}/m_{Mg}$ in the matrix so that after an exhaustion of Zr, we obtain a layer of thickness e on the fibres of radius $r_f$ in a composite, where the volume fraction of said fibres is equal to $V_f$. It should be noted that said ratio, a rising function of $V_f$, is proportional to e and inversely proportional to $r_f$. On replacing $d_c$, $x_O$ and $d_{Mg}$ by their value, we arrive at:

$$m_{Zr}/m_{Mg}=6.713\cdot e\cdot V_f/r_f(1-V_f) \quad (10)$$

Thus, for composite materials, whereof the volume fraction of fibres varies from 5 to 55%, the ratio $m_{Zr}/m_{Mg}$ varies from 0.0035 to 0.082, if it is wished to obtain a layer thickness of 0.1 μm on diameter 10 μm fibres. To satisfy this condition, use is generally made of magnesium alloys containing 0.3 to 1% by weight zirconium.

The zirconium which remains in the magnesium matrix after infiltration and formation of the $ZrC_xMg_y$ layer is not prejudicial to the characteristics of the matrix. In fact, the addition of zirconium to magnesium improves the mechanical properties of the magnesium and several magnesium-based industrial alloy formulas integrate this element as a main additive.

Other elements can be present in the magnesium matrix with the zirconium and in particular zinc, thorium, silver and rare earths. However, the magnesium matrix must not contain aluminium, because the latter combines with the zirconium to give undesirable refractory intermetallic compounds. Moreover, the aluminium reacts with the carbon reinforcement so as to damage the same by puncturing, as stated hereinbefore.

Thus, in the invention it is possible to use commercially available magnesium alloys containing zirconium and other addition elements, but not aluminium. These addition elements can e.g. be Zn and rare earths.

The composite materials according to the invention, which comprise a magnesium matrix combined with a carbon reinforcement constituted by carbon fibres having high mechanical properties such as a specific breaking strength and modulus of elasticity as high as $0.6.10^6$ and $1.6.10^8 N.m.kg^{-1}$ respectively in a direction parallel to the fibres, when using fibres of type FT 700 with a fibre volume fraction of 50%. Moreover, when using carbon fibres with a high modulus of elasticity, such as type FT 700 or P 100 fibres having a sufficiently negative thermal expansion coefficient, the composite materials have an excellent dimensional stability in a wide temperature range (−180° to +150° C.). The above characteristics combined with a good thermal conductivity and high chemical stability make the composite materials according to the invention particularly suitable for the production of structural elements or apparatus supports usable in a space environment the corrosion problems inherent in the use of a magnesium-based matrix not being critical in this case.

Other features and advantages of the invention can be gathered from the study of the following examples given in an illustrative and non-limitative manner.

The characteristics of the carbon fibres used in these examples are given in the attached table.

EXAMPLE 1

This example uses type M40B, desized carbon fibres in the form of wicks of 3000 fibres with an average diameter of 6.5 μm and they are placed in a graphite crucible around a zirconium-saturated Mg—Zr alloy cylinder (500 mg of alloy +150 mg of zirconium), followed by heating to 677° C., which is maintained for 16 h.

Under these conditions, there is a capillary rise of the molten alloy along the wick of fibres over a height of 2 mm. It can also be seen that the alloy has completely infiltrated the wick and that an interaction layer with an approximate thickness of 1 μm has formed round each fibre.

When working at 677° C. for 15 min, there is still a capillary rise of the magnesium alloy along the wick of fibres over a height of 1 to 2 mm, as well as the complete infiltration of the latter, but the reaction layer is still present on the fibres with a much smaller thickness of approximately 0.1 μm.

EXAMPLE 2

In this example preparation takes place of a composite material using as the reinforcement a three-dimensional carbon preform and by carrying out the infiltration of the magnesium matrix into the reinforcement from a magnesium alloy bath containing zirconium.

The carbon preform is a 1×1×3 cm parallelepipedic preform produced by three-dimensional weaving of LT 300 carbon wicks, each formed from 6000 carbon fibres and each having an average diameter of 6 μm. The open porosity of the preform is approximately 60%.

After desizing the preform, it is immersed to a depth of 10 cm in a graphite container containing a commercially available magnesium-zirconium alloy liquid bath containing 0.4 to 1% by weight zirconium, the bath volume being 50 times higher than the apparent volume of the preform.

In order to passivate the graphite container containing the alloy bath, it was previously brought into contact with an identical bath for 24 h and at 750° C. After immersing the preform for 6 min in the bath kept at a temperature of 657° C., the preform is removed and it is cooled to ambient temperature.

It is found that virtually all the reinforcement fibres are covered with solidified metal due to the excellent reactive wettability which bas developed during immersion. A continuous 0.04 to 0.06 m thick $ZrMg_xC_y$ layer has formed at the interface between the metal and each of the fibres. The thus obtained composite material can be used as a local insert for a part having a more complex shape produced by casting.

EXAMPLE 3

In this example, a composite material part having the shape of a ribbon or tape is produced from a carbon fibre wick and a magnesium-zirconium alloy. The reinforcement is constituted by an untwisted wick formed from 3000, diameter 7 μm carbon fibres, each fibre having on its surface an approximately 0.1 μm thick pyrolytic carbon coating previously deposited by heating by the Joule effect the fibres at approximately 1300° C. under a low methane pressure.

In order to produce the composite ribbon, the carbon fibre wick is continuously passed into the magnesium-zirconium alloy bath, whose zirconium content is maintained at saturation by contact with a zirconium excess. This is carried out by a horizontally axed return pulley, which vertically drives from top to bottom the carbon fibre wick in the liquid alloy bath, the pulley radius being 3 cm and its axis or shaft being kept above the bath surface, whereas the fibre wick travelling in its groove is immersed to a depth of 2 cm below the bath surface. After passing over the pulley and traversing the alloy bath, the fibre wick is moved onto a horizontally axed smaller roller located outside the bath, but sufficiently close to its thickness to ensure that the solidification of the metal infiltrated into the wick intervenes on the roller. The pulley and all the parts in contact with the liquid bath are made from graphite and passivated as in example 2, by prior contacting with an identical bath for 24 h and at 750° C.

In order to carry out the infiltration, the temperature of the bath is maintained at 670° C. and its zirconium content at saturation (0.6% by weight zirconium at this temperature) by placing metallic zirconium fragments at the bottom of the bath.

After spending 2 min in the liquid alloy bath, a composite ribbon is obtained constituted by 3000 carbon fibres infiltrated to the core by the magnesium-zirconium alloy, the average volume fraction of said fibres being approximately 45% and each of then being coated with a 0.03 to 0.04 μm thick $ZrC_xMg_y$ layer. These ribbons can be used for the production by hot compression of bars, sections or thin pieces of revolution.

EXAMPLE 4

In this example preparation takes place of a composite material part from unidirectional layers of carbon fibres, magnesium-zirconium alloy strips and zirconium powder having a small grain size (less than 25 μm).

To this end, unidirectional layers of p 100 carbon fibre wicks are arranged in alternating manner and on same has been dispersed the zirconium powder and RZ5 alloy strips containing 3.5 to 5% by weight Zn, 0.4 to 1% by weight Zr and 0.75 to 1.75% by weight rare earths, the remainder being magnesium, so as to have 53% by weight wicks, 1.5% by weight zirconium powder and 45.5% by weight RZ5 alloy strips.

The thus formed stack is placed in a tight enclosure, which then undergoes uniaxal compression under 50 MPa, at a temperature of 670° C. and for 15 min. This gives a composite plate containing approximately 50% by volume of P 100 wicks coated with a metal matrix having the composition of the starting RZ 5 alloy, each fibre being covered with a 0.04 to 0.06 μm thick $ZrC_xMg_y$ layer.

EXAMPLE 5

In this example a composite material is produced from carbon fibre layers coated with alloy RZ 5 and metallic zirconium by cathodic sputtering.

For this purpose spreading takes place of FT 700 carbon fibres and on same is then deposited by cathodic sputtering in a magnetron field a first RZ 5 alloy layer and then a second metallic zirconium layer. This gives a semi-finished product, in which the weight proportion of fibres is 58%, the weight proportion of alloy 40.4% and the weight proportion of zirconium 1.6%.

After placing the semi-finished products round a cylindrical mandrel, they undergo isostatic compression under 15 MPa, at 650° C. and for 20 min.

This gives a composite material constituted by 55% by volume FT 700 fibres covered with a 0.04 to 0.06 μm thick $ZrC_xMg_y$ layer and covered with a matrix having the composition of alloy RZ 5.

This embodiment is more particularly suitable for producing tubular parts.

COMPARATIVE EXAMPLE

In this example preparation takes place of a carbon fibre-based composite material in a magnesium matrix, but to the magnesium is added titanium instead of zirconium and heating takes place at 727° C. for 4 or 64 h.

After 4 h, a titanium carbide layer has formed, but there is no excellent wetting such as occurs with Mg—Zr alloys. After 64 h this means that there is no contact at certain points of the metal-fibre interface, whilst an interaction zone of more than one micrometer is visible at other locations. Thus, the development of a good reactive wetting between the carbon fibres and the magnesium alloys is a characteristic specific to the zirconium additive.

The following factors have a determinative influence on the reactive wetting procedure:

the deterioration rate of the Mg0 oxide layer liable to form a screen at the metal/fibre interface, the formation and growth rate of the $ZrC_xMg_y$ layer, and the value of the carbide-liquid alloy contact angle.

Thus, it would appear that the zirconium permits a favourable compromise between these factors, which is not the case with titanium.

Although hereinbefore the infiltration methods have only been illustrated by immersion in a liquid bath or by hot compression of solid products, it is clear that any other known infiltration method, can be used in the process according to the invention.

Thus, it is possible to carry out an impregnation by immersion, an infiltration by gravity or an infiltration under medium pressure in order to produce a composite material according to the invention, from the instant when the temperature and time during which the carbon reinforcement is in contact with the liquid alloy are compatible with the formation, by chemical reaction at the metal-reinforcement interface, of a zirconium carbide interaction layer containing magnesium in solid solution, such as $ZrC_xMg_y$, with an appropriate thickness, preferably below 1/100 of the diameter of the reinforcement fibres.

TABLE

| Fiber type | Fiber Diameter (um) | Density (g/cm$^3$) | Breaking strength (MPa) | Modulus of Elasticity (GPa) | Fibers per wick (n) | Manufacturer or supplier |
|---|---|---|---|---|---|---|
| M40B | 6.5 | 1.81 | 2750 | 392 | 3000 | Toray |
| P55 | 10 | 2.0 | 1900 | 380 | 2000 | Amoco |
| P100 | 10 | 2.15 | 2240 | 720 | 2000 | Amoco |
| FT700 | 10 | 2.16 | 3300 | 700 | 3000 | Tonen |
| T300 | 6 | 1.76 | 3530 | 230 | 6000 | Toray |

We claim:

1. Process for the production of a composite material comprising a magnesium alloy matrix containing zirconium and a reinforcement of graphite or carbon fibres dispersed in said matrix and having a zirconium carbide layer containing magnesium in solid solution at the interface between the fibres and the magnesium-based matrix, which comprises infiltrating into said reinforcement a liquid magnesium alloy containing zirconium, the zirconium content said alloy being maintained at saturation during said infiltrating, said infiltration carried out at a temperature of 650° to 850° C. while maintaining said temperature for about 2–60 min.

2. Process according to claim 1, characterized in that infiltration takes place by immersing a carbon or graphite fibre reinforcement in a molten magnesium alloy bath.

3. Process according to claim 1, characterized in that infiltration takes place by hot compression of an alternating stack of carbon or graphite fibre reinforcements, magnesium alloy strips and zirconium powder.

4. Process according to claim 1, characterized in that the magnesium alloy does not contain aluminium.

* * * * *

UNITED STATES PATENT AND TRADEMARK OFFICE

CERTIFICATE OF CORRECTION

PATENT NO. : 5,705,229
DATED : January 6, 1998
INVENTOR(S) : ABIVEN ET AL

It is certified that error appears in the above-indentified patent and that said Letters Patent is hereby corrected as shown below:

Claim 1, Col. 12, line 9, after "content" insert --of--

Signed and Sealed this

Twelfth Day of May, 1998

Bruce Lehman

*Attest:*

BRUCE LEHMAN

*Attesting Officer*

*Commissioner of Patents and Trademarks*